US005768898A

United States Patent [19]

Seok et al.

[11] Patent Number: 5,768,898

[45] Date of Patent: Jun. 23, 1998

[54] REFRIGERATOR HAVING FLUORESCENT LAMP FOR ILLUMINATING FRESH FOOD COMPARTMENT

[75] Inventors: Jin Oh Seok; Jong Ki Kim; Jong Hyun Lee, all of Suwon; Kwang Ho Kim; Jin Ho Choi, both of Seoul, all of Rep. of Korea

[73] Assignee: Samsung Electronics Co., Ltd., Suwon, Rep. of Korea

[21] Appl. No.: 710,027

[22] Filed: Sep. 11, 1996

[30] Foreign Application Priority Data

| | | | |
|---|---|---|---|
| Sep. 18, 1995 | [KR] | Rep. of Korea | U.M.95-25094 |
| May 23, 1996 | [KR] | Rep. of Korea | 96-17745 |
| May 23, 1996 | [KR] | Rep. of Korea | 96-17833 |

[51] Int. Cl.[6] ..... F25B 49/00

[52] U.S. Cl. ..... 62/132; 62/440; 62/131; 62/264; 362/92; 362/94

[58] Field of Search ..... 62/440, 264, 131, 62/132, 231, 157; 362/94, 92, 93; 312/401, 408, 223.5

[56] References Cited

U.S. PATENT DOCUMENTS

| | | | |
|---|---|---|---|
| 2,632,313 | 3/1953 | Fehr | 362/94 |
| 3,612,848 | 10/1971 | Koch et al. | 362/94 |
| 5,079,681 | 1/1992 | Baba et al. | 362/94 |

*Primary Examiner*—John M. Sollecito

[57] ABSTRACT

In a refrigerator having a fluorescent lamp for illuminating a fresh food compartment in which the fluorescent lamp is installed in the fresh food compartment, and is turned on and off according to the opening and closing of a door for opening and closing the fresh food compartment, the refrigerator includes a heater which is installed adjacent to the fluorescent lamp to heat the peripheral portion of the fluorescent lamp. The refrigerator maintains a peripheral temperature of a fluorescent lamp at an appropriate temperature for lighting up the fluorescent lamp, to thereby prevent failure in the light-up of the fluorescent lamp and the reduction of illumination after lighting up the fluorescent lamp.

7 Claims, 5 Drawing Sheets

REFRIGERATOR HAVING FLUORESCENT LAMP FOR ILLUMINATING FRESH FOOD COMPARTMENT

BACKGROUND OF THE INVENTION

The present invention relates to a refrigerator having a fluorescent lamp for illuminating a fresh food compartment of the refrigerator. A typical refrigerator has an internal lamp which is turned on and off according to the opening and closing of a door of the refrigerator. An incandescent lamp is chiefly used for the refrigerator since the former can be turned on and off immediately after the opening and closing of the door of the latter. Since a fluorescent lamp needs a relatively longer lighting-up time compared with an incandescent lamp and exposes a flickering phenomenon until the lamp is illuminated it has generally been undesirable to use a fluorescent lamp in a refrigerator which needs a frequently lighting-up operation.

There has occured a recent trend toward the use of increasingly larger refrigerators, in which a fluoresent lamp is being used. Since a fluorescent lamp has several merits including (1) a high efficiency due to a low consumption power of one third through a quarter times that of an incandescent lamp, (2) a comfortable light and a small amount of radiant heat, and (3) a lifetime of 5–10 times compared with the incandescent lamp, it is appropriate to employ the fluorescent lamp in a large-sized refrigerator.

FIG. 6 shows a schematic circuit diagram of a general fluorescent lamp portion. A fluorescent lamp 60 is turned on through steps of pre-heating filaments 57 and 58 of two discharge electrodes and then applying a high voltage across the filaments to start discharge thereof. The filaments 57 and 58 are pre-heated to a state capable of emitting thermal electrons and starts emission of the thermal electrons according to the high voltage applied after the pre-heating step, to thereby light up the fluorescent lamp 60. A starter 55 comprised of a bimetal contact and a magnetic ballast 53 are chiefly used to appropriately pre-heat the filaments 57 and 58. The filaments 57 and 58 in the fluorescent lamp 60 are connected to respective ends of the starter 55. The filaments 57 and 58 are also respectively connection to the ends of a circuit having the ballast 53 and an AC power supply 51 connected in series to each other. A light-up switch 54 for controlling the light-up of the fluorescent lamp 60 is interposed between the AC power supply 51 and the fluorescent lamp 60. Accordingly, a closed circuit (hereinafter referred to as a pre-heating closed circuit) is formed by a cycle of an AC power supply 51, a ballast 53, a left filament 57, a starter 55, a right filament 58, a light-up switch 54 and the AC power supply 51.

When the light-up switch 54 is turned on, power is supplied from the AC power supply 51 along the pre-heating closed circuit, to pre-heat the filaments 57 and 58. Upon the completion of the pre-heating steps the current flow is interrupted by the starter 55. As a result, a counter-electromotive force of a high voltage is generated from the ballast 53 to start emission of the thermal electrons from the filaments 57 and 58. Discharge gases in the fluorescent lamp 60 are excited by the thermal electrons to light up the lamp 60. After light-up the lamp, a closed circuit hereinafter referred to as a light-up closed circuit) is formed by a cycle of the AC, power supply 51, a ballast 53, the left filament 57, the right filament 58, the light-tip switch 54 and the AC power supply 51, to maintain the light-up of the lamp 60. When the light-up switch 54 is turned off, the lamp 60 is extinguished.

A fluorescent lamp should be turned on simultaneously or in the shortest time after opening the door of a refrigerator. However, when a fluorescent lamp is used for illuminating a fresh food compartment in a refrigerator, the filaments in the fluorescent lamp are not properly pre-heated due to an internal temperature of the fresh food compartment extremely lower than a temperature appropriate to light up the fluorescent lamp, to accordingly reduce an amount of emitted thermal electrons which can cause failure in lighting up the lamp. Since an amount of discharge gases which are excited by the emitted thermal electrons is comparatively small even though the lamp has been lighted up, proper brightness cannot be provided for a considerable time after lighting up the lamp.

SUMMARY OF THE INVENTION

To solve the above problem, it is an object of the present invention to prevent insufficient illumination of a fluorescent lamp in a refrigerator and a reduction of the illumination after the lamp, by maintaining a peripheral temperature of the fluorescent lamp at a temperature appropriate to light up the lamp.

To accomplish the above object of the present invention, there is provided a refrigerator having a fluorescent lamp for illuminating a fresh food compartment in which the fluorescent lamp is installed and is turned on and off according to the opening and closing of a door, the refrigerator comprising a heater which is installed adjacent to the fluorescent lamp to heat the peripheral portion of the fluorescent lamp.

It is preferable that the heater be turned on or off according to the operation or non-operation of a cooling fan for blowing a cool air produced in an evaporator to the fresh food compartment, to thereby energize the heater of the heater during the cooling operation of the fresh food compartment.

The refrigerator may further comprises a temperature sensor for sensing a peripheral temperature of the fluorescent lamp and a temperature controller for turning on the heater when the sensed peripheral temperature of the fluorescent lamp is not more than a predetermined value to maintain an accurate control over a temperature necessary to light up the fluorescent lamp.

It is also preferable that the heater is turned on simultaneously with the opening of the door, to thereby more effectively prevent a reduction of an initial illumination of the lamp, the heater would be turned off after a predetermined time lapses from the turn-on state.

DETAILED DESCRIPTION OF THE PREFERRED EMBODIMENTS

Figure 1:
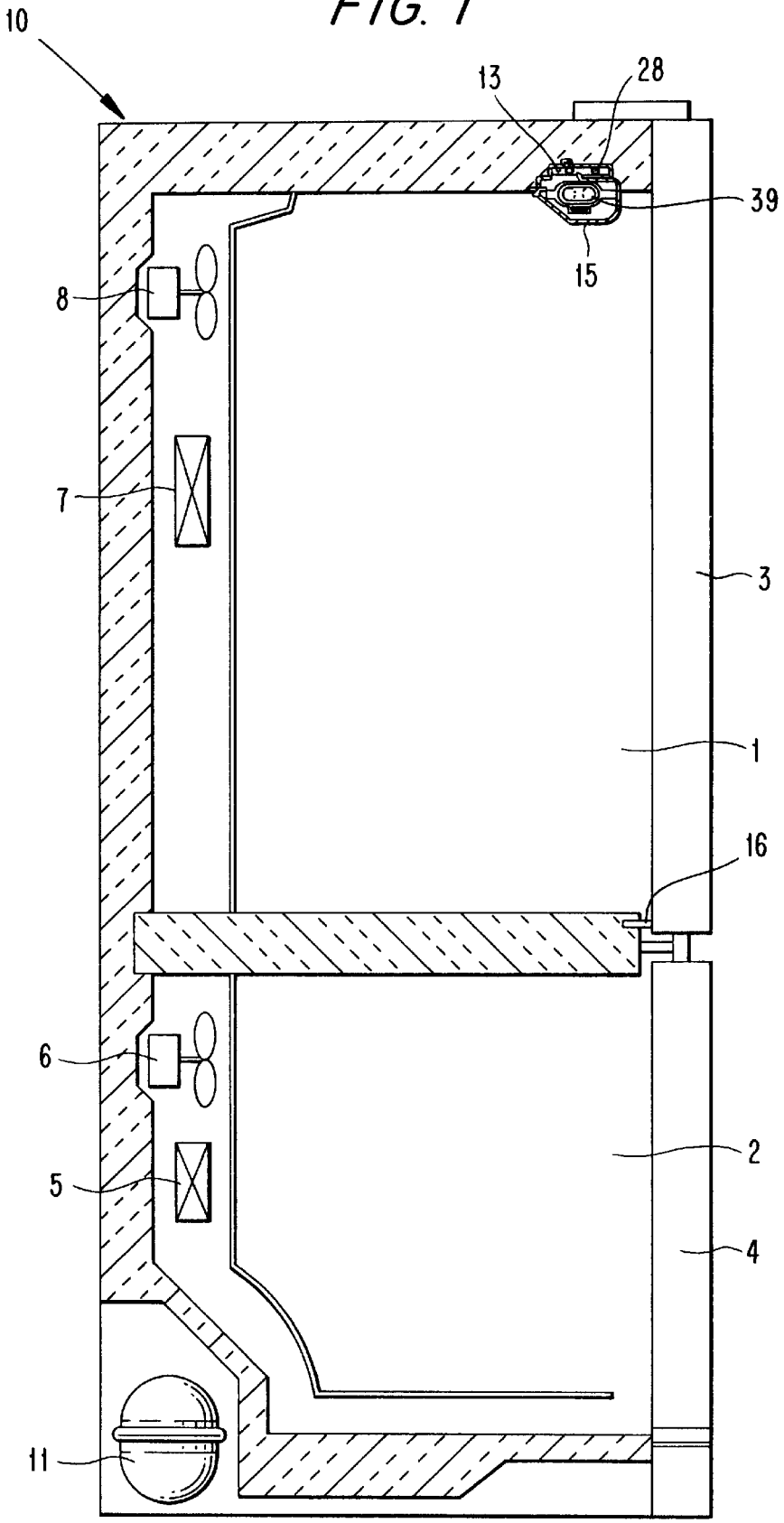
FIG. 1 is a side sectional view of a refrigerator according to the present invention.

Preferred embodiments of the present invention will be described below in more detail with reference to the accompanying drawings. FIG. 1 is a side sectional view of a refrigerator according to the present invention and FIG. 2 is an enlarged sectional view of a fluorescent lamp portion shown in FIG. 1.

Figure 2:
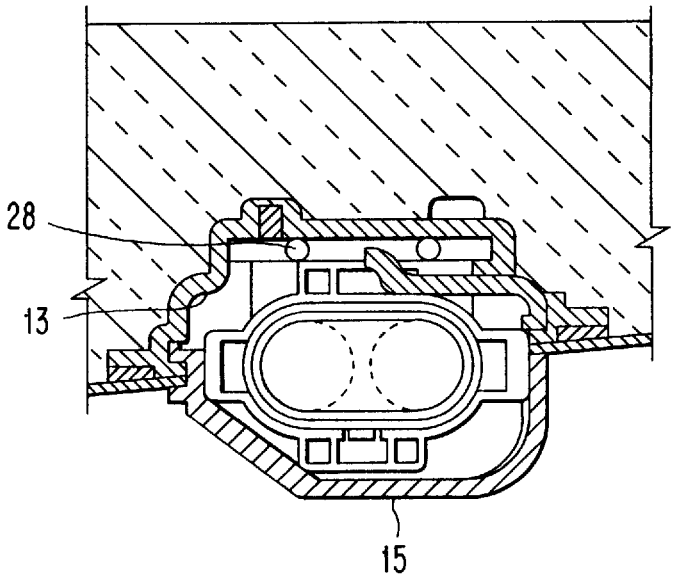
FIG. 2 is an enlarged sectional view of a fluorescent lamp portion shown in FIG. 1.
Figure 6:
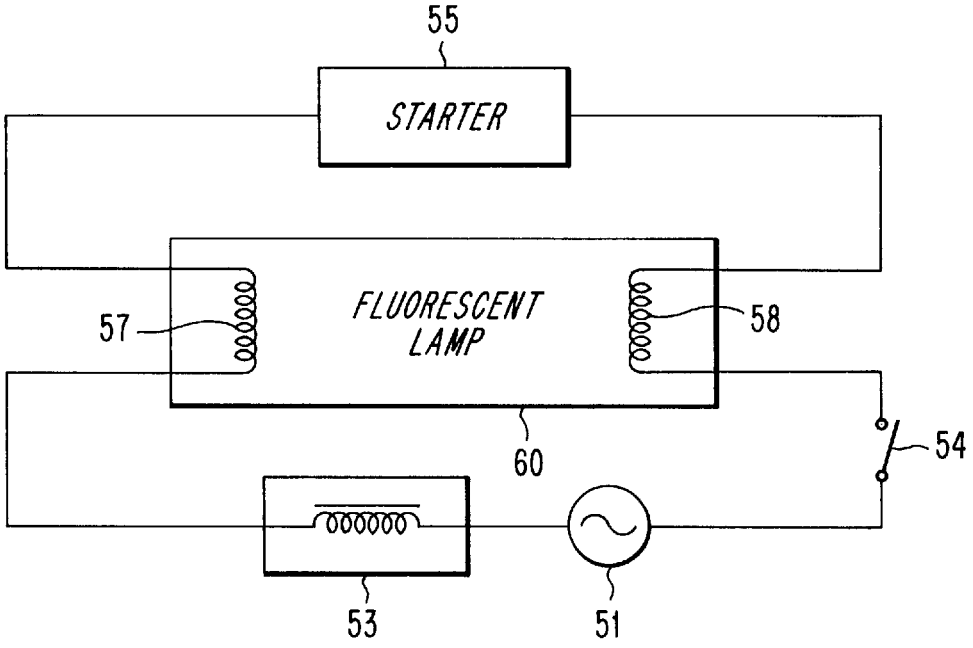
FIG. 6 (PRIOR ART)
FIG. 6 shows a schematic circuit diagram of a prior art fluorescent lamp.

As shown in FIGS. 1 and 2, a refrigerator according to the present invention includes a thermally insulated main body 10 housing a freezing compartment 2 and a fresh food compartment 1 vertically partitioned from each other and a freezing compartment door 4 and a fresh food compartment door 3 for opening and closing the freezing compartment 2 and the fresh food compartment 1, respectively.

A compressor 11, a condensator (not shown), a freezing compartment evaporator 5 and a cold-storage room evaporator 7 are installed in the main body 10, which performs a cycle of a freezing operation. Cold air is produced from each evaporator 5 or 7. A freezing compartment fan 6 and a fresh food compartment fan 8 are respectively installed over the evaporators 5 and 7, which forcedly blow the cold air produced from the respective evaporators 5 and 7 to the freezing compartment 2 and the fresh food compartment 1.

A fluorescent lamp 39 is installed on the upper ceiling wall in the fresh food compartment 1. A groove 13 is formed to accomodate the fluorescent lamp 39 on the upper ceiling wall in the fresh food compartment 1. Accordingly, the fluorescent lamp 39 is accommodated in the groove 13. The fluorescent lamp 39 in the groove 13 is covered with a lamp case 15 made of a light-transmissive material. The lamp case 15 protects the fluorescent lamp 39 and partitions the space in which the fluorescent lamp 39 is accommodated, from the other space in the fresh food compartment 1.

A door switch 16 operating according to the opening and closing of the fresh food compartment 3 is in,stalled in the lower end of the fresh food compartment door 3. The door switch 16 is turned off bad the pressure of the fresh food compartment door 3 when the fresh food compartment door 3 is closed, and is turned on by the released pressure of the fresh food compartment door 3 when the fresh food compartment door 3 is open. The fluorescent lamp it is turned on and off according to the switching operation of the door switch 16.

An auxillary heater 28 is installed on the upper surface of the fluorescent lamp 39 in the groove 13. The heater 28 heats the space accommodating the fluorescent lamp 39 partitioned by the lamp case 15 when power is supplied from the power supply, to increase a peripheral temperature of the fluorescent lamp up to an appropriate temperature to light up the fluorescent lamp.

Figure 3:
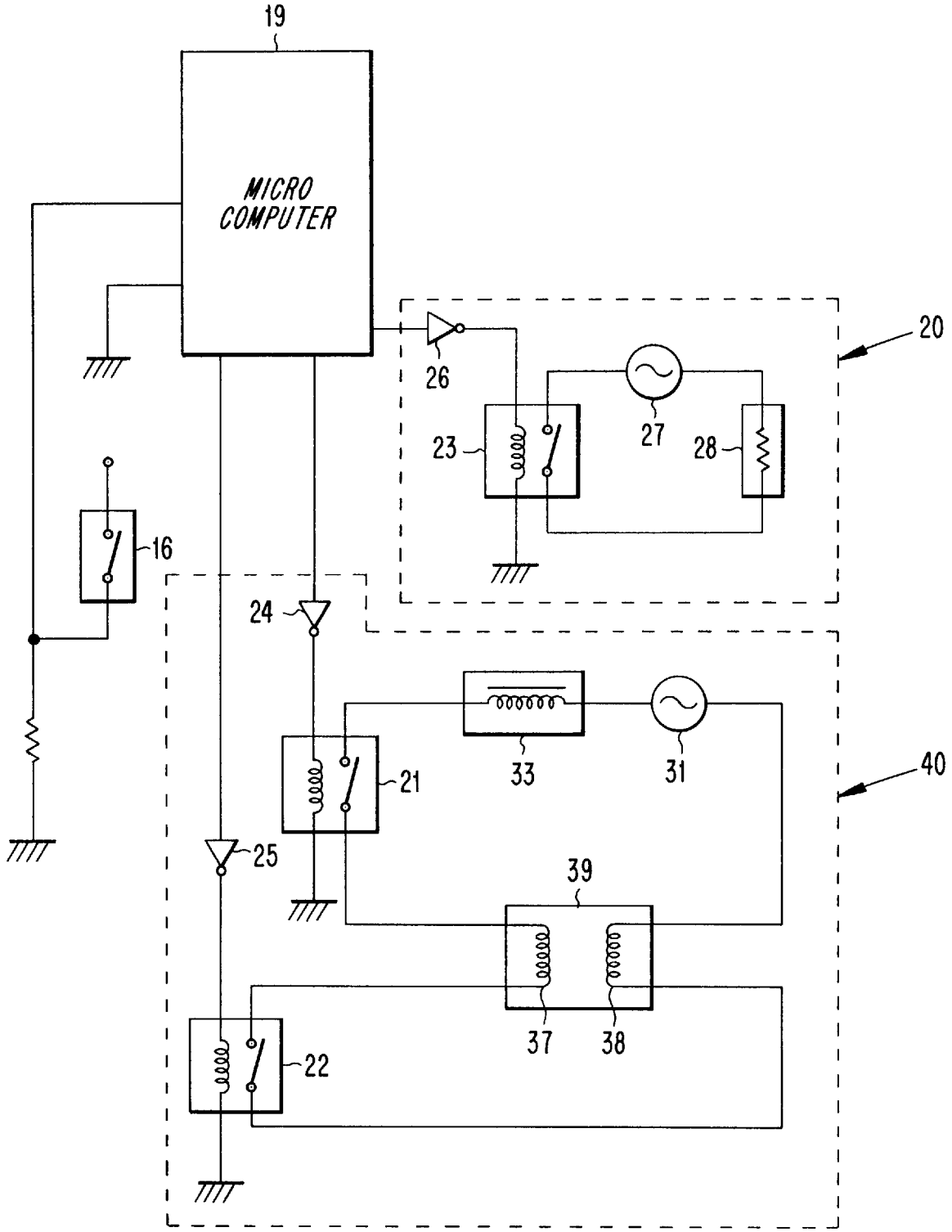
FIG. 3 schematically show s a control circuit for controlling the fluorescent lamp according to one embodiment of the present invention.

FIG. 3 schematically shows a control circuit for controlling the fluorescent lamp according to one embodiment of the present invention. The control circuit is under control of a microcomputer 19. The door switch 1ti is connected to the input end of the microcomputer 19 and a heater circuit 20 and a fluorescent lamp circuit 40 are connected to the output end thereof. The fluorescent lamp circuit 40 includes the fluorescent lamp 39, a magnetic ballast 33, an AV power supply 31 for supplying the power To facilitate the control of the microcomputer 19, the second relay 22 which is connected and disconnected by the microcomputer 19 is used instead of a bimetal type glow starter employed in a conventional fluorescent lamp circuit. Filaments 37 and 38 are installed in both ends of the fluorescent lamp 39. The first relay 21, the ballast 33 and the AC power supply 31 are connected in series to each one end of the filaments 37 and 38. Meanwhile, the other ends of the filaments 37 and 38 are connected to each other via the second relay 22.

The first and second relays 21 and 22 are connected and disconnected by the microcomputer 19, from which the signal is transmitted to the first and second relays 21 and 22 composed of driving IC via first and second buffers 24 and 25, respectively. Each buffer 24 or 25 plays a role of converting an electrical signal supplied from the microcomputer 19 into a current level necessary for a switching function of each relay 21 or 22. Th heater circuit 20 includes a heater 28, at heater power supply 27 for supplying power to the heater 28, and a third relay 23 for connecting and disconnecting power to the heater 28. The third relay 23. is also under control of the microcomputer 19. A third buffer 26 is interposed between the microcomputer 19 and the third relay 23, which play s at role of converting an electrical signal supplied from the microcomputer 19 into a current level necessary for a switching function of the third relay 23.

The microcomputer 19 detects the opening of the fresh food compartment door 3 via the door switch 16, to cause a light-up operation of the fluorescent lamp 39. The first relay 21 is always maintained in the turn-on state by the microcomputer 19. When the door switch 16 is turned on, the microcomputer 19 turns on the second relay 22. Accordingly, a pre-heating closed circuit is formed by a cycle of the AC power supply 31, the ballast 33, the first relay 21, the left filament 37, the second relay 22, the right filament 38, and the AC power supply 31, to start a pre-heating operation for lighting up the fluorescent lamp 39. An appropriate pre-heating time range is 0.5–1 seconds. After the pre-heating time lapses, the microcomputer 19 turns off the second relay 22. When the second relay 22 is turned off, thermal electrons are emitted from the filaments 37 and 38 by the counter-electromotive force of a high voltage produced from the ballast 33, to light up the fluorescent lamp 39. Thereafter a light-up closed circuit is formed by a cycle of the AC power supply 31, the ballast 33, the first relay 21, the left filament 37, the right filament 38, and the AC power supply 31, to continuously maintain the light-up of the fluorescent lamp 39.

Meanwhile, when the door switch 16 is turned on, that is, the microcomputer 19 detects the opening of the fresh food compartment door 3, the second relay 22 is turned on to pre-heat the filaments 37 and 38, and the third relax 23 is turned on simultaneously to operate the heater 28. Thus, the filaments 37 and 38 are pre-heated and at the same time the space accommodating the fluorescent lamp 39 is heated to increase a peripheral temperature of the fluorescent lamp 39 up to an appropriate temperature to light up the fluorescent lamp 39. The microcomputer 19 turns off the third relay 23 once a predetermined time lapses after lighting up the fluorescent lamp 39, to stop the operation of the heater 28. Here, the predetermined time is a sufficient time for preventing reduction of illumination at an initial light-up of the fluorescent lamp 39, which corresponds to several seconds. Once several seconds lapse after the initial light-up of the lamp, the filaments 37 and 38 and discharge gases in the fluorescent lamp 39 are sufficiently heated and activated, to prevent the reduction of the illumination, which makes further operation of the heater 28 unnecessary.

Figure 4:
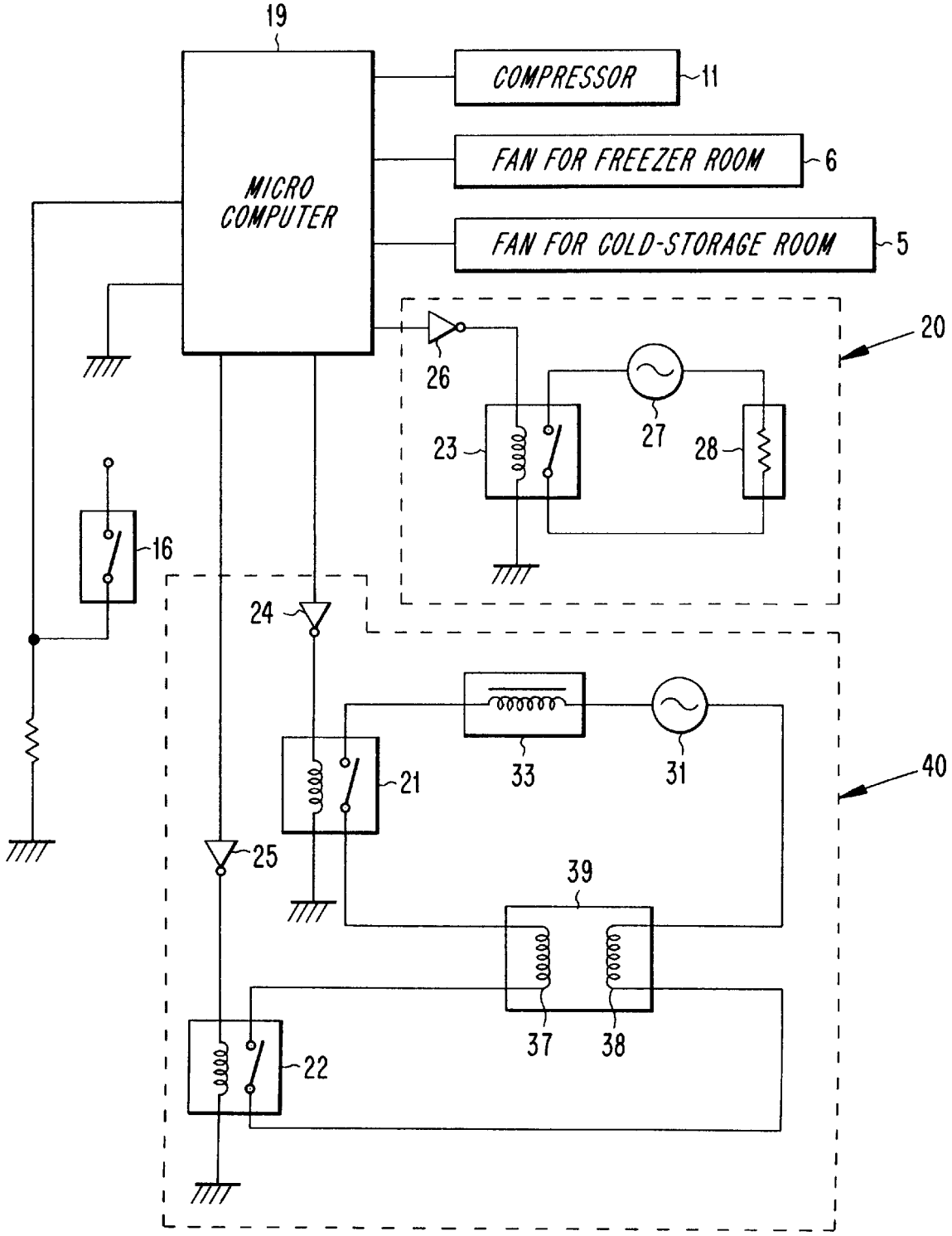
FIG. 4 schematically show,s a control circuit for controlling the fluorescent lamp according to another embodiment of the present invention.
Figure 5:
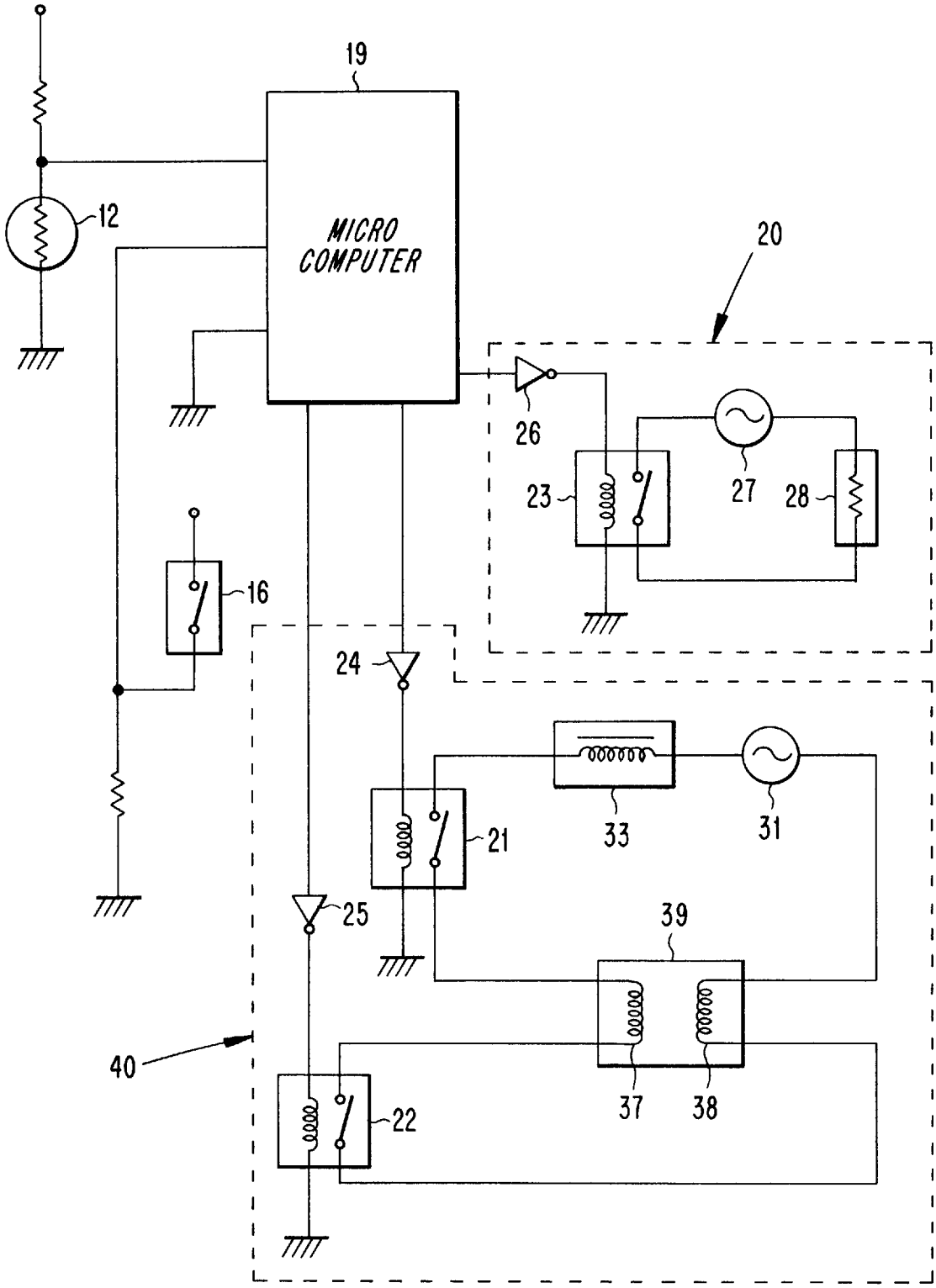
FIG. 5 schematically shows a control circuit for controlling the fluorescent lamp according to still another embodiment of the present invention.

Once the fresh food compartment door 3 is closed and the door switch 16 is turned off, the microcomputer 19 turns off the first relax 21 to turn off the fluorescent lamp 39. If the fresh food compartment door 3 is closed and the door switch 16 is turned off during operation of the heater 28, the microcomputer 19 turns off the first relay 21 and the third relay 23 to stop the operation of the heater 28. In the above-described embodiment, the heater 28 operates according to the operation of the door switch 16. However, alternatively the heater 28 may always operate during operation of the refrigerator, or may operate intermittently every interval of a predetermined time. Since the space accommodating the fluorescent lamp 39 is partitioned by the lamp case 15 from the internal space of the fresh food compartment 1, a cooling efficiency of the fresh food compartment 1 is rarely lowered due to a continuous or intermittent operation of the heater 28. Also, an operation of the heater 28 according to the opening and closing of the fresh food compartment door 3 may be employed together with the continuous or intermitted operation of the heater 28 FIG. 4 schematically shows a control circuit for controlling the fluorescent lamp according to another embodiment of the present invention. In this embodiment, the constructions of the door switch 16, the heater circuit 20 and the fluorescent lamp circuit 40 are the same as those in the FIG. The microcomputer 19 controls a compressor 11, a freezing compartment fan 6 and a fresh food compartment fan 8. When it is necessary to perform a cooling operation due to an increased temperature in the freezing compartment 2 and the fresh food compartment 1, the microcomputer 19 starts driving of the compressor 11 to produce cold air and drives the freezing compartment fan 6 and the fresh food compartment fan 8 to supply the cold air to the freezing compartment 2 and the fresh food compartment 1, respectively. The microcomputer 19 turns on the third relay 23 to operate the heater 28 if the fresh food compartment fan 8 is driven to supply cold air to the fresh food compartment 1, while the microcomputer 19 turns off the third relax 23 to stop the operation of the heater 28 if the fresh food compartment fan 8 stops the operation of supplying cold air to the fresh food compartment 1. As a result, the heater 28 operates only when the cold air is being supplied to the fresh food compartment 1, to maintain a temperature of the space of accommodating the fluorescent lamp 39 to be appropriate for lighting up the fluorescent lamp 39. FIG. 5 schematically shows a control circuit for controlling the fluorescent lamp according to still another embodiment of the present invention. In this embodiment, a temperature sensor 12 is installed in the space accommodating the fluorescent lamp 39. The constructions of the door switch 16, the heater circuit 20 and the fluorescent lamp circuit 40 are the same as those in the FIGS. 3 and 4. The microcomputer 19 controls operation of the heater 28 based on a sensed temperature of the space of accommodating the fluorescent lamp 39 the sensing preformed by the temperature sensor 12. Generally, a fluorescent lamp normally operates at a temperature not less than 8° C. Thus, it is desirable that a peripheral temperature of the fluorescent lamp 39 is maintained at about 8° C., since too an excessively high temperature of the periphery of the fluorescent lamp may lower a cooling efficiency of the fresh food compartment.

The microcomputer 19 constantly senses the temperature of the space accommodating the fluorescent lamp 39 by means of the temperature sensor, and controls operation of the heater 28 so that a peripheral temperature of the fluorescent lamp 39 is maintained at not less than 8°C., on the basis of the sensed temperature. That is, if the temperature of the space accommodating the fluorescent lamp 39 goes down to not more than 8° C., the microcomputer 19 causes the heater to operate, to accordingly maintain an appropriate temperature to light up the fluorescent lamp 39 without any difficulty.

As described above, the present invention provides a refrigerator for maintaining a peripheral temperature of a fluorescent lamp at an appropriate temperature for lighting up the fluorescent lamp, to thereby prevent failure in the light-up of the fluorescent lamp and the reduction of illumination after lighting up the fluorescent lamp. In particular, since a heater can operate according to operation of a cooling fan, or can operate based on a sensed temperature value it is possible to accurately control the heater at an appropriate temperature for lighting up the fluorescent lamp.

What is claimed is:

1. A refrigerator comprising:

a body forming a fresh food compartment;

a door mounted on the body for opening the compartment;

a fluorescent lamp disposed in the compartment and arranged to be turned on and off in response to an opening and closing, respectively, of the door;

a heater positioned adjacent to the fluorescent lamp for heating the lamp; and a fan for circulating cool air to the compartment, the heater and fan disposed in a circuit which energizes the heater in response to the fan being activated.

2. The refrigerator according to claim 1 further including a space formed in a wall of the compartment, the lamp and heater disposed in the space, and a partition for isolating the space from the compartment.

3. A refrigerator comprising:

a body forming a fresh food compartment;

a door mounted on the body for opening the compartment;

a fluorescent lamp disposed in the compartment and arranged to be turned on and off in response to an opening and closing, respectively, of the door;

a heater positioned adjacent to the fluorescent lamp for heating the lamp;

a space formed in a wall of the compartment, the lamp and heater disposed in the space, and a partition for isolating the space from the compartment; and a temperature sensor arranged adjacent to the lamp, the heater and temperature sensor arranged in a circuit which energizes the heater in response to a sensed temperature being below a reference value.

4. A refrigerator comprising:

a body forming a fresh food compartment;

a door mounted on the body for opening the compartment;

a fluorescent lamp disposed in the compartment and arranged to be turned on and off in response to an opening and closing, respectively, of the door;

a heater positioned adjacent to the fluorescent lamp for heating the lamp;

a space formed in a wall of the compartment, the lamp and heater disposed in the space, and a partition for isolating the space from the compartment; and a switch for sensing an opening of the door, the switch and heater disposed in a circuit which energizes the heater in response to the door being open.

5. The refrigerator according to claim 4 wherein the circuit is operable to deenergize the heater once the heater has been energized for a predetermined time period.

6. A refrigerator comprising:

a body forming a fresh food compartment;

a door mounted on the body for opening the compartment;

a fluorescent lamp disposed in the compartment and arranged to be turned on and off in response to an opening and closing, respectively, of the door; a heater positioned adjacent to the fluorescent lamp for heating the lamp; and a space formed in a wall of the compartment, the lamp and heater disposed in the space, and a partition for isolating the space from the compartment;

wherein the heater is in a circuit which cyclically energizes the heater for predetermined intervals.

7. A refrigerator comprising:

a body forming a fresh food compartment;

a door mounted on the body for opening the compartment;

a fluorescent lamp disposed in the compartment and arranged to be turned on and off in response to an opening and closing, respectively, of the door;

a heater positioned adjacent to the fluorescent lamp for heating the lamp; and a space formed in a wall of the compartment, the lamp and heater disposed in the space, and a partition for isolating the space from the compartment;

wherein the heater is continuously energized while the refrigerator operates.

* * * * *